US007088253B2

(12) United States Patent
Grow

(10) Patent No.: US 7,088,253 B2
(45) Date of Patent: Aug. 8, 2006

(54) FLAME DETECTOR, METHOD AND FUEL VALVE CONTROL

(75) Inventor: Fred Grow, McHenry, IL (US)

(73) Assignee: Protection Controls, Inc., Skokie, IL (US)

( * ) Notice: Subject to any disclaimer, the term of this patent is extended or adjusted under 35 U.S.C. 154(b) by 115 days.

(21) Appl. No.: 10/775,925

(22) Filed: Feb. 10, 2004

(65) Prior Publication Data

US 2005/0174244 A1 Aug. 11, 2005

(51) Int. Cl.
*G08B 17/12* (2006.01)

(52) U.S. Cl. ..... 340/578; 250/372; 431/79; 313/539

(58) Field of Classification Search ..... 340/577–578; 250/372; 313/538–539, 540–542; 315/150; 431/25, 78, 79

See application file for complete search history.

(56) References Cited

U.S. PATENT DOCUMENTS

| | | | | |
|---|---|---|---|---|
| 2,944,152 | A * | 7/1960 | Johnson et al. | 250/372 |
| 3,336,479 | A * | 8/1967 | Blackett | 250/372 |
| 3,493,753 | A * | 2/1970 | Stowe | 250/372 |
| 3,541,549 | A * | 11/1970 | Graves | 431/24 |
| 3,574,496 | A * | 4/1971 | Hewitt | 431/71 |
| 3,755,799 | A * | 8/1973 | Riccardi | 340/507 |
| 3,854,056 | A * | 12/1974 | Cade | 307/117 |
| 3,936,648 | A * | 2/1976 | Cormault et al. | 250/554 |
| 4,000,961 | A * | 1/1977 | Mandock | 431/2 |
| 4,328,527 | A * | 5/1982 | Landis | 361/175 |
| 4,823,114 | A * | 4/1989 | Gotisar | 340/578 |
| 4,835,525 | A * | 5/1989 | Egi et al. | 340/578 |
| 5,189,398 | A * | 2/1993 | Mizutani | 340/578 |
| 5,256,057 | A | 10/1993 | Grow | |

FOREIGN PATENT DOCUMENTS

DE 2532448 A * 1/1977

OTHER PUBLICATIONS

Hamamatsu UVtron® (Ultraviolet Detector Tube) Technical Information—Jul. 1984.
Maier Electronics, Inc. U.V. Detector Tube PX-1 Specifications—Undated.
Maier Electronics Inc. U.V. Detector Tube PX-1—Undated.

* cited by examiner

*Primary Examiner*—Jeffery Hofsass
*Assistant Examiner*—Anne V. Lai
(74) *Attorney, Agent, or Firm*—Wood, Phillips, Katz, Clark & Mortimer

(57) ABSTRACT

A flame detector and burner fuel valve control has an ultraviolet sensitive, cold cathode, gas discharge tube in a DC quench circuit. In the presence of a flame, the circuit generates a pulse signal at a frequency related to the intensity of radiation from the flame. The pulse signal from a contaminated tube is at a higher frequency. A frequency discriminator circuit distinguishes between a flame responsive signal and a contaminated tube signal and controls the burner fuel valve.

33 Claims, 7 Drawing Sheets

FLAME DETECTOR, METHOD AND FUEL VALVE CONTROL

BACKGROUND OF THE INVENTION

Industrial burners utilize a flame detector in a fuel valve control to enable opening of a fuel valve in the presence of a flame or conversely, to close the fuel valve in the absence of a flame. The preferred optical flame detector is an ultraviolet sensitive, cold cathode, gas discharge tube, hereinafter generally referred to as a UV tube.

A UV tube has cathode and anode elements in a gas filled envelope through which ultraviolet rays are transmitted to the cathode element. The cathode emits electrons when exposed to ultraviolet rays, as from a flame. The electrons are accelerated from a negatively charged cathode to an anode charged to the discharge starting voltage and ionize the gas filling the tube by colliding with molecules of the gas, generating both negative electrons and positive ions. The electrons are attracted to the anode and the ions to the cathode, generating secondary electrons. A gas discharge avalanche current flows between cathode and anode. With the UV tube connected in a quenching circuit, the anode/cathode voltage drops below the discharge sustain voltage of the tube and conduction ceases. As charge drains from the quench circuit, the anode/cathode voltage is again sufficient to initiate conduction and the cycle repeats, resulting in a pulse signal at a frequency directly related to the intensity of the ultraviolet rays.

In the absence of UV stimulation, a UV tube will conduct when the anode/cathode voltage exceeds the breakdown voltage $V_B$. Conduction ceases when the anode/cathode voltage drops below the discharge stopping voltage $V_D$.

UV tubes, however, are subject to failure from contamination of the electrodes or the gas. When the UV tube is contaminated, the time for the gas and ions to neutralize increases and the voltage at which conduction occurs is reduced. This results in a higher frequency of operation; and in conduction indicative of a flame in the absence of a flame. It is known to shield the UV tube from the flame intermittently with a mechanical shutter to identify a contaminated tube. Conduction of the tube with the shutter closed indicates tube contamination. Mechanical shutters, however, have moving parts and require frequent maintenance.

UV tubes are also subject to an apparent shifted spectral response (SSR) of reduced signal to noise condition in which the pulse rate increases in the absence of UV radiation. I believe the condition may be due to the deposition of electrode material on the inner wall of the tube which in turn traps some of the gas atmosphere within the tube lowering the gas density and reducing $V_B$ and $V_D$. Another cause appears to be contamination in new UV tubes in the form of particles which become electrostatically charged. This condition also reduces $V_B$ and $V_D$. In turn, the occurrence of pulse signals in the anode/cathode circuit in the absence of UV radiation increases and the signal to noise ratio of the anode/cathode circuit decreases. Detection of the apparent SSR condition is enhanced by periodically increasing the anode/cathode operating voltage $V_0$.

BRIEF SUMMARY OF THE INVENTION

This invention is concerned with a flame detector circuit utilizing an UV flame sensor tube in which the detector circuit distinguishes between the operation of a normal UV tube and that of a contaminated UV tube. More particularly, the flame detector circuit comprises a UV flame sensor tube having a cathode and an anode, a DC supply, a cathode/anode circuit, including a quench circuit, connecting the cathode and anode of the ultraviolet tube with the DC supply. A desired pulse signal is generated in the cathode/anode circuit by action of the quench circuit in the presence of a burner flame and undesired pulse signals are generated in the cathode/anode circuit if the ultraviolet tube is contaminated or in the absence of a burner flame. A discriminator circuit responds to the pulse signal in the cathode/anode circuit and distinguishes between the desired flame responsive pulse signal and the undesired pulse signal to generate an output signal. An output circuit controls the fuel valve in response to the discriminator circuit output signal. No mechanical shutter is needed.

The detector circuit preferably operates in concert with a combustion safeguard circuit which is typically used with a flame rod sensor in a burner control. The detector circuit provides both an enabling function for the burner fuel valve in the presence of a flame and a lockout function to close the fuel valve in the absence of a flame or on occurrence of an abnormal condition in the detector circuit. The flame detector and fuel valve control have multiple redundant and fail safe features which will be described below.

Another feature of the invention is that a desired pulse signal is generated in the cathode/anode circuit of the UV tube at a selected nominal frequency in the presence of a flame and undesired pulse signals are generated in the cathode/anode circuit at other frequencies if the UV tube is contaminated or in the absence of a flame. If the flame generates a pulse signal at a frequency greater than the selected frequency, the flame detector is calibrated by attenuating the ultraviolet radiation so that the UV tube circuit generates a pulse signal at the selected nominal frequency.

Further features and advantages of the invention will be apparent from the drawings and the following detailed description.

DETAILED DESCRIPTION OF THE INVENTION

Figure 1:
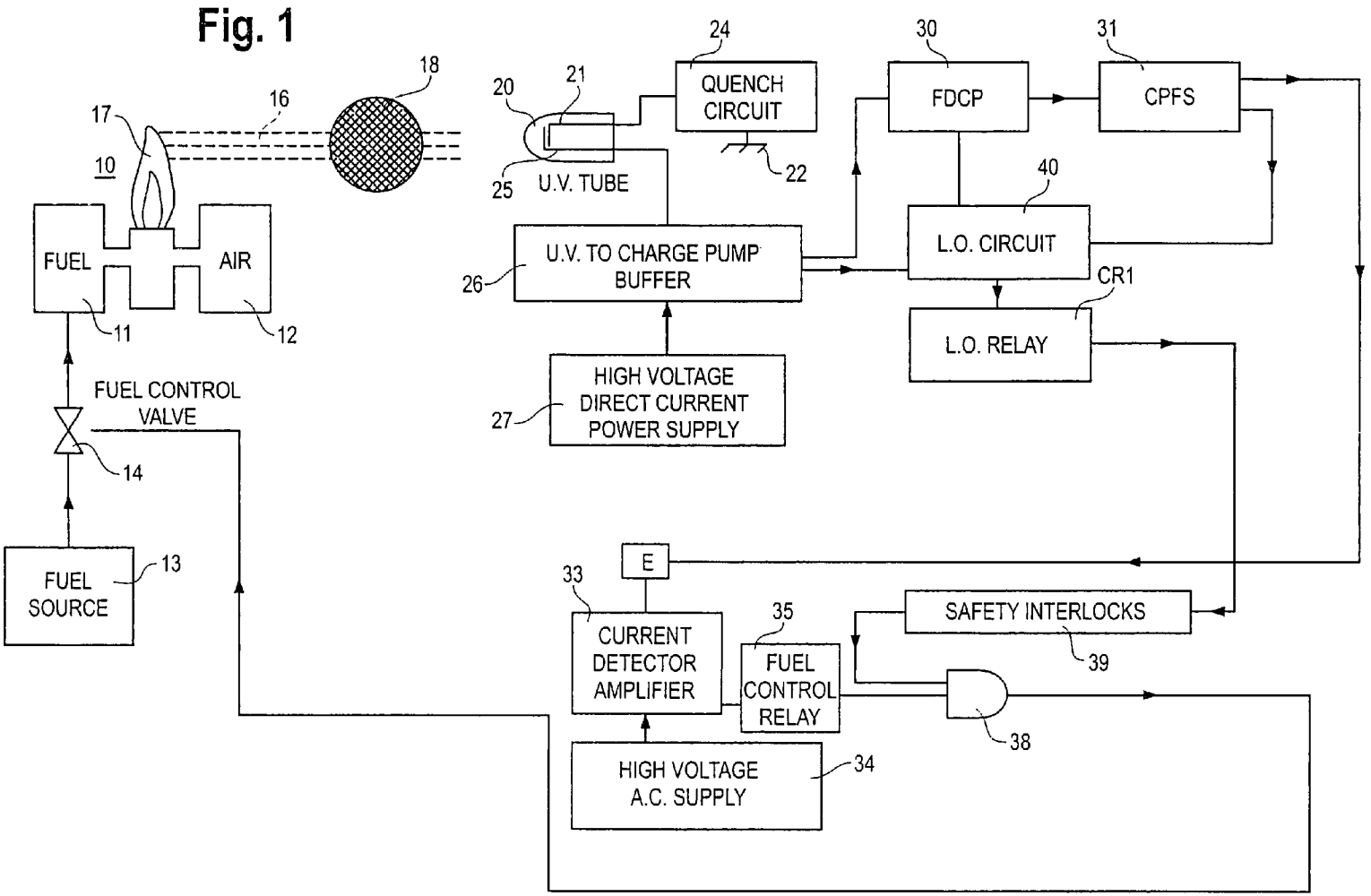
FIG. 1 is a simplified block diagram of the burner, flame detector and combustion safeguard circuits.

The basic operation of the flame detector and burner fuel valve control is illustrated in FIG. 1. A burner 10 has fuel and air inputs 11 and 12, respectively. A fuel source 13 is connected through a fuel control valve 14 with burner fuel input 11. UV radiation 16 from flame 17 is directed through an attenuating screen 18 to a UV sensor tube 20. No mechanical shutter is needed to interrupt the radiation periodically. The anode electrode 21 of the sensor tube is connected with a signal reference or ground 22 through quench circuit 24. Cathode electrode 25 is connected through a buffer circuit 26 with a high voltage direct, current power supply 27.

The repetition rate or frequency of the pulses in the sensor tube circuit is a function of the intensity of the UV radiation, the DC voltage applied to the tube and the time constant of quench circuit 24. The UV tube circuit may generate pulses at a low frequency as a result of electrical noise or cosmic rays, in the absence of UV radiation. A contaminated UV tube holds residual ions at a damage site and the pulse frequency is much higher than that of a good UV tube regardless of the UV radiation. Thus, the sensor tube pulse frequency can be utilized to discriminate between a flame condition on one hand and a contaminated UV tube (high frequency) or the absence of a flame (low frequency).

A UV sensor tube with a quench circuit is not a stable oscillator. With a continuous flame, the pulse rate may vary from a nominal rate by a factor of the order of ±40%. However, the pulse rate for a contaminated tube will be greater than twice the nominal rate; and the pulse rate in the absence of a flame is less than 5% of the nominal value. The quench and flame detector circuits described herein are designed for a nominal sensor tube pulse frequency of 250 hz. The burner control is calibrated for a flame which produces UV radiation causing a pulse frequency above 500 hz by attenuating the radiation directed to the UV tube. Preferably, this is done by inserting one or more fine mesh screens 18 in an orifice (not shown) in the optical path between the burner 10 and the UV tube 20 to achieve the nominal sensor tube pulse rate of 250 hz. A discriminator circuit to be described below acts as a band pass filter for the desired pulse signal from 10 to 500 hz. A pulse frequency in this range indicates that a flame is present. A frequency less than 10 hz indicates no flame; a frequency greater than 500 hz indicates a contaminated UV tube.

Buffer 26 couples the pulse signal from the anode/cathode circuit of the UV tube to a frequency dependent charge pump 30 (hereinafter FDCP). The FDCP is a discriminator circuit which acts as a band pass filter for the desired pulse signal from 10 to 500 hz. A pulse signal from the FDCP is connected with an output circuit including a charge pump flame simulator 31 (hereinafter CPFS).

Many existing burner controls utilize a combustion safeguard circuit which combines the output of a flame rod sensor and system interlocks, as indicative of fuel and air supplies, fan operation, etc., to open or enable the fuel valve. A flame rod sensor typically generates a low microampere DC current in the presence of a flame. This current is sensed in the combustion safeguard circuit and the fuel valve is opened.

The CPFS circuit 31 of the flame detector generates a comparable microampere DC current in response to a flame pulse signal in the 10–500 hz frequency range so that the UV flame detector can be used in place of a flame rod sensor with an existing burner control combustion safeguard circuit. In the block diagram of FIG. 1 the output of CPFS 31 is connected with terminal E of a combustion safeguard circuit. Current detector amplifier 33 which has a high voltage AC supply 34, energizes fuel control relay 35 in the presence of flame 17. A contact of fuel control relay 35 is connected, effectively, in an AND circuit 38 with safety interlocks 39 to operate fuel control valve 14.

In addition to the direct approach of opening or closing the fuel valve in the presence or absence of flame 17, the fuel valve control includes a lockout subsystem which closes the fuel valve upon the occurrence of any one or more of various circuit conditions to be described below. The lockout subsystem is illustrated here as a lockout circuit 40 having inputs from buffer 26, FDCP 30 and CPFS 31. On occurrence of a lockout condition, lockout circuit 40 operates lockout relay CR1, opening contacts connected, effectively, in the safety interlock circuit 39 to close fuel valve 14.

Figure 2:
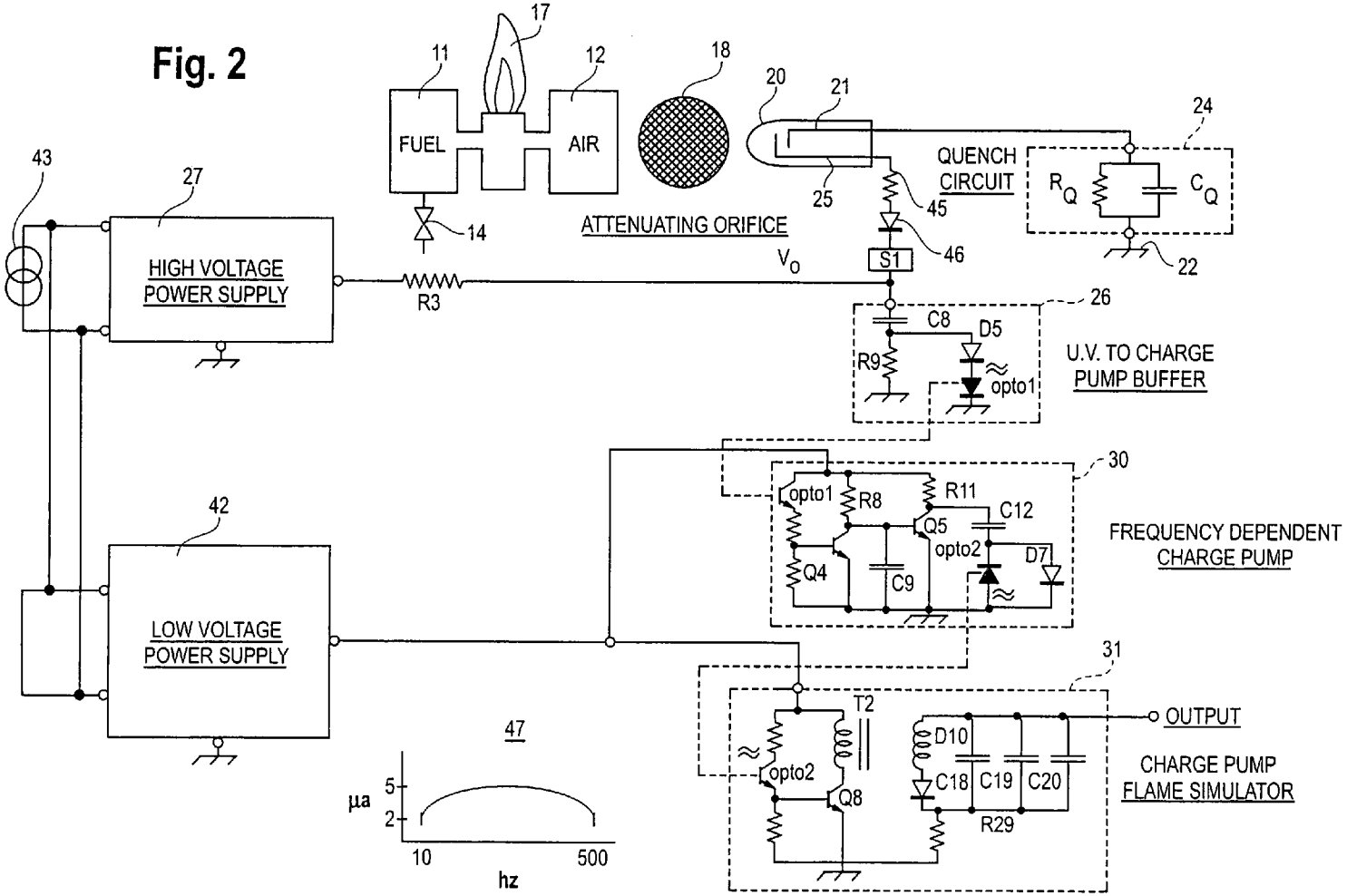
FIG. 2 is a simplified diagram of the burner and flame detector.

The basic components of the UV tube circuit, FDCP 30 and CPFS 31 are illustrated in FIG. 2. High voltage direct current power supply 27 and low voltage direct current power supply 42 are connected with a suitable power source 43, such as 120 volts, 60 cycle AC. UV sensor tube 20 has cathode electrode 25 connected through current limiting resistor 45 and diode 46 with signal terminal S1 and through R3 with the negative high voltage power supply 27. Anode electrode 21 is connected through quench circuit 24, the parallel combination of $R_Q$ and $C_Q$, with signal ground 22. Buffer circuit 26 is connected from signal terminal S1 to ground and comprises a series capacitor C8 and resistor R9 with a blocking diode D5 and the light emitting diode (LED) of opto (optocoupler) 1 connected across R9. C8 is the filter capacitor for the high voltage power supply. R9 controls the instantaneous discharge current through UV tube 20. D5 protects the LED of opto 1 from reverse voltage.

The power supply operating voltage $V_o$ is greater than the UV tube starting voltage $V_s$, the minimum voltage required for the UV tube to avalanche. With UV radiation incident on the cathode of the UV tube, the tube will conduct. When the tube conducts, quench circuit capacitor $C_Q$ charges until the voltage across the tube ($V_o$–$V_{CQ}$) is less than the voltage $V_{sustain}$, required to maintain tube conduction. The quench circuit components $R_Q$ and $C_Q$ are selected so that the tube conduction time is short, e.g., 0.5 μsec. This causes a negative pulse with a duration of 0.5 μsec in the cathode circuit at signal terminal S1.

When the UV tube stops conducting, $C_Q$ discharges through $R_Q$ and the voltage across the tube rises. If ultraviolet radiation is still impinging on cathode electrode 25, the UV tube will conduct again when the anode/cathode voltage reaches $V_s$. If there has not been sufficient time for the ionized gas molecules to neutralize, the firing voltage is reduced.

Light pulses representing the current pulses in UV tube 20 are coupled by opto 1 of the buffer circuit 26 to FDCP 30. In the FDCP, Q4 is normally off and Q5 is normally on so that C12 has no charge. The photo transistor of opto 1 couples the 0.5 μsec pulses to Q4, turning it on for 0.5 μsec. This discharges C9 and turns Q5 off. C12 starts to charge through R11. When the sensor tube pulse rate reaches 10 hz, C12 will have sufficient charge to power the LED of opto 2 when Q5 turns on as each pulse ends. Opto 2 couples the pulses to CPFS 31. As each sensor tube pulse ends, C9 starts to recharge through R8. When the pulses from UV tube 20 are at 500 hz, the charge on C9 never reaches the voltage necessary to turn Q5 off and no further signal is coupled to the CPFS 31. Thus, with a pulse frequency from the UV sensor tube circuit between 10 hz and 500 hz, pulses are coupled through opto 2 to CPFS 31. If the sensor tube pulse frequency is less than 10 hz or greater than 500 hz, no pulses are coupled to CPFS 31.

Q8 of CPFS 31 is normally off. When the light activated transistor of opto 2 receives a pulse from FDCP 30, Q8 conducts and current flows through the primary winding of transformer T2. When Q8 turns off, the magnetic field of the transformer collapses inducing a pulse in the secondary winding which is rectified by diode D10 and stored in capacitors C18, C19 and C20. The charge in these capacitors provides a DC current of the order of 5 μamperes at the output which is connected to the E terminal of the current detector 33 in the combustion safeguard, an input simulating that of a flame rod sensor and enabling the opening of fuel control valve 14.

The CPFS current (or power output) as a function of UV tube pulse frequency is illustrated by the curve at 47. Maximum power output or 5 μamp current is at the nominal frequency, 250 hz, and minimum power or 2 μamp current is at 10 hz and 500 hz. Below 10 hz and above 500 hz, there is insufficient power output to actuate the combustion safeguard.

The described portion of the circuit provides the basic operation of opening or enabling opening of the fuel valve in the presence of a flame and closing the fuel valve in the absence of a flame or with a contaminated UV tube. Redundant and ancillary features of the circuit to be described below contribute to reliability and fail safe burner control.

Figure 3A:
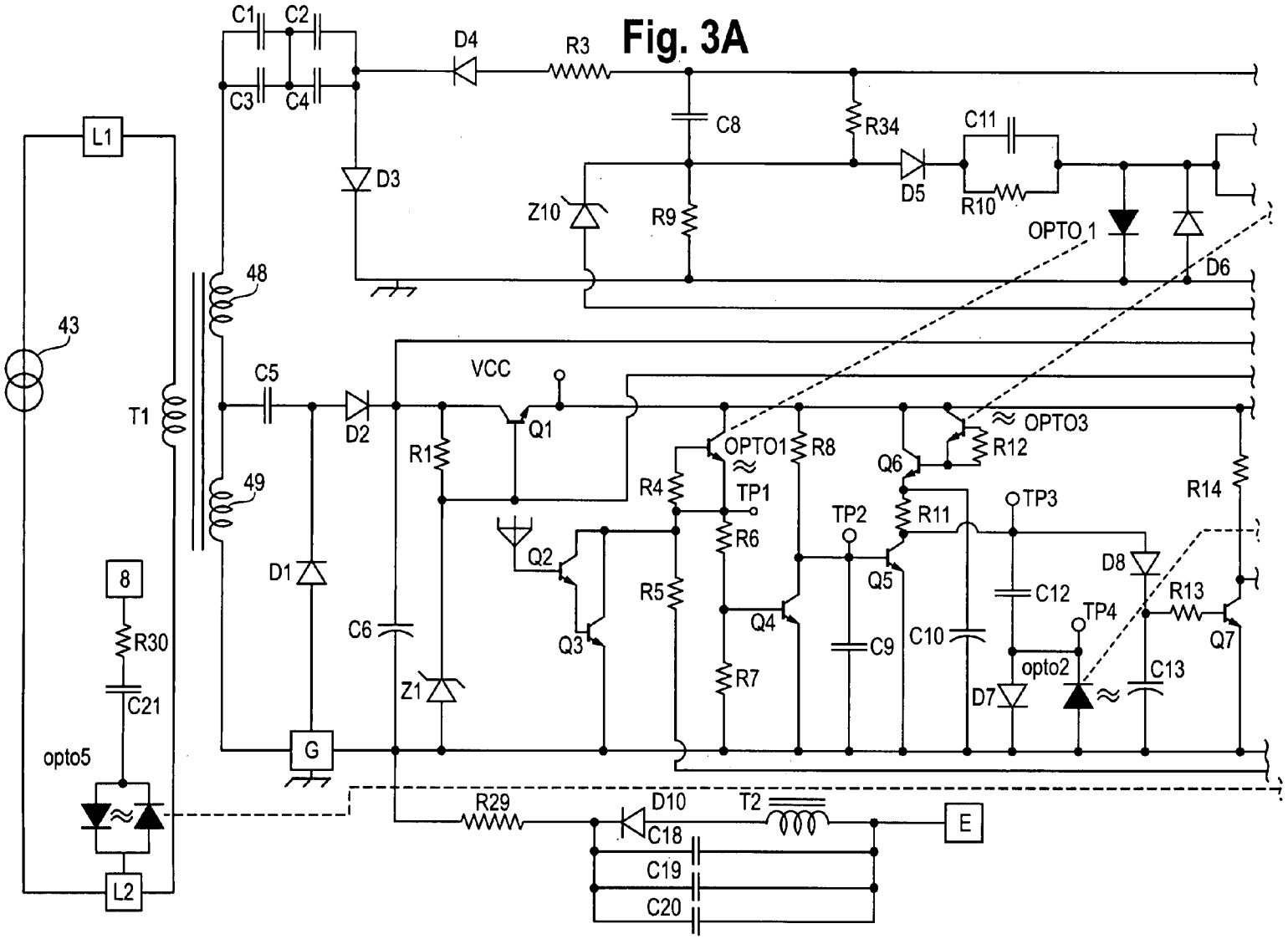
FIG. 3 is a schematic of the flame detector.
Figure 3B:
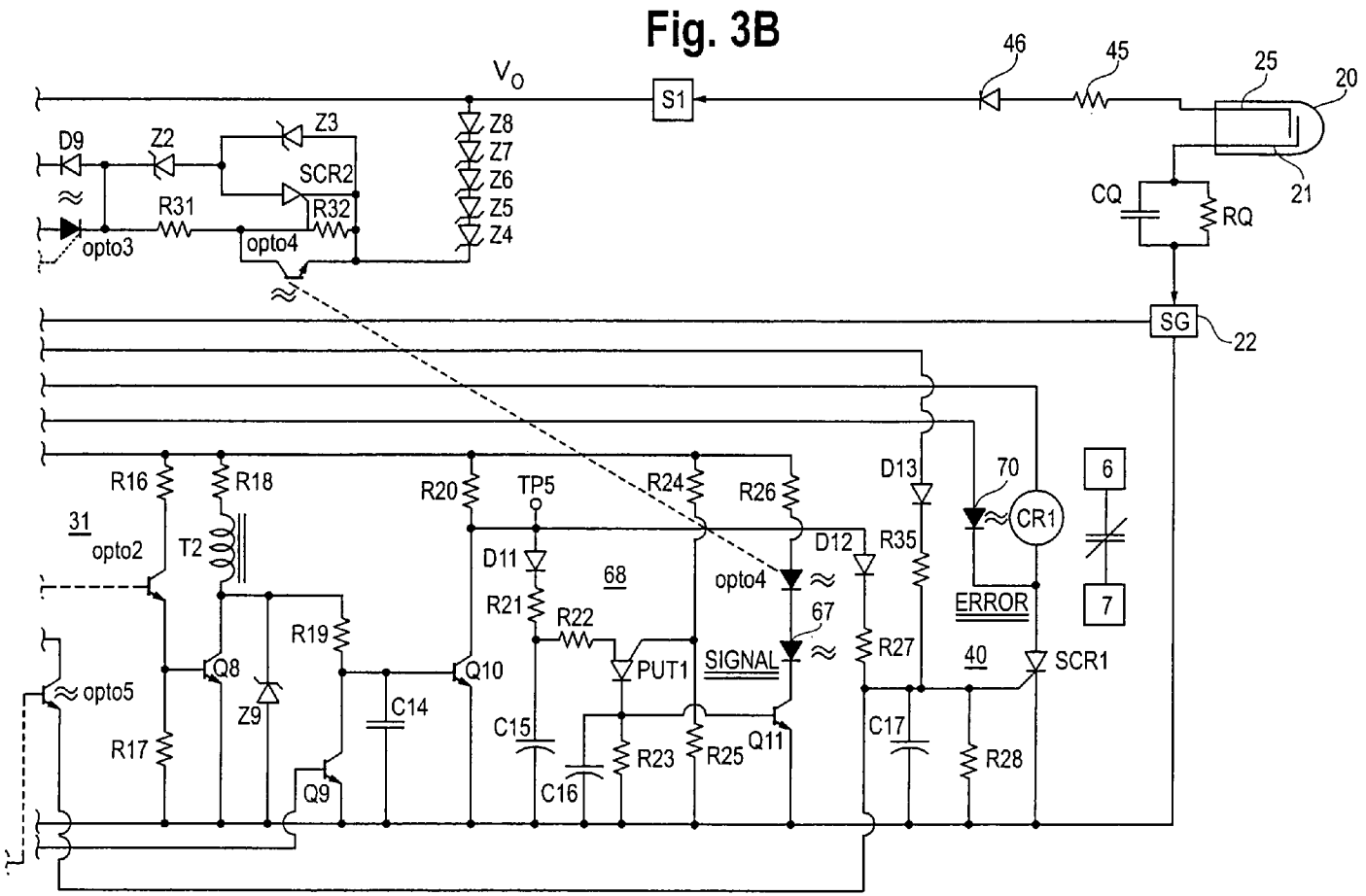

In the following discussion of the flame detector schematic, FIGS. 3A and 3B, suitable component types will be identified for some circuit elements; and component values will be given where they are particularly relevant to the circuit operation. This specific information is intended to be illustrative of an operational embodiment of the detector and is not intended to be limiting. The opto couplers are type H11AA1. Unless otherwise indicated, the transistors are type 2N3390.

The flame detector circuit is powered from AC source 43 connected with line terminals L1, L2 and the primary winding of transformer T1. The high voltage DC supply is a voltage doubler, diodes D3, D4, which are capacity coupled across transformer secondary windings 48, 49. Coupling capacitors C1, C2, C3 and C4, connected in a series parallel circuit, are each 0.033 uf, 250 volts DC. This is less expensive than a single 700 volt capacitor. The capacitors serve as a current limiting impedance. The high voltage is regulated by the circuit of zeners, Z2, Z3, Z4, Z5, Z6, Z7 and Z8, each 75 volts, SCR2, R32, R31, the LEDs of optos 1 and 3, D9 and D6. R3, 31 Kohm is a current limit for the high voltage regulator. When the voltage of the high voltage supply exceeds about minus 460 volts DC there is current flow through D6 and opto LED 3 to the junction of R31 and Z2. The voltage at this point biases SCR2 on, shorting out Z3. The values of R31, R32 and R3 are selected so that SCR2 cannot go into $I_h$ and so that opto transistor 4 across the gate to cathode of SCR2 can turn SCR2 off. The purpose of this circuit will be described below. Current flows through Z2, SCR2 and Z4–Z8. The six zeners clamp $V_0$ at minus 450 volts. R34, 10 Meg ohm, bleeds filter capacitor C8 when power is removed.

R9 charges C8 and controls the current through opto LED1. Diode D5 protects opto LED1 from reverse voltage.

Buffer circuit 26 is operated at essentially ground potential, rather than the elevated voltage of the high voltage supply. This precludes the electrostatic attraction of dust particles to opto 1 LED. R10, C11 protect the LED of opto 1 if the signal terminal S1 should be shorted to ground.

The low voltage DC supply is voltage doubler D1, D2 coupled across transformer secondary winding 49 by C5, with filter capacitor C6. A series pass regulator includes R1, Z1, 18 volts, and Q1, 2N3405, and establishes a positive DC voltage of 18 volts.

With the high voltage regulator operating properly the current through opto LED3 turns on opto 3 transistor and Q6, connecting the circuit of Q5 with the low voltage DC supply and enabling FDCP 30. Conversely, in the event of a fault in the high voltage supply opto LED3 is not on and Q5 is not connected with the low voltage supply. This disables the low voltage supply and shuts off the flame detector. C10 is charged by Q6 when the transistor of opto 3 conducts to provide power for Q5 and the LED of opto 2 in FDCP 30.

The UV sensor tube 20 preferably has line discharge tungsten electrodes in a hydrogen atmosphere. A suitable tube is a type PX-1 of Maier Electronics, Inc. The tube has a starting voltage $V_S$ of 300 volts. $V_{sustain}$ is≈275 volts.

With a power supply voltage of minus 460 volts and quench circuit components $R_Q$ 100 Kohm, and $C_Q$, 0.002 μf, the UV tube circuit nominal frequency is adjusted if necessary to 250 hz in the presence of a burner flame by adding one or more attenuator screens 18. As noted above the instantaneous frequency may vary between 150 and 350 hz.

UV tube 20 must be mounted close to burner 10 in what is sometimes referred to as a scanner. The series connected quench circuit is preferable to the commonly used parallel connected quench circuit. The large capacity (0.002 μf) of the series circuit permits the circuit to be physically spaced from the scanner without effecting the quench time constant. A typical parallel connected quench circuit has a capacitor of the order of 200 pf and a resistor of 10 meg Ω. The parallel quench circuit cannot be spaced from the scanner because the wiring capacitance would undesirably increase the time constant. Thus, with a parallel circuit the scanner must either be a 3 wire device with a weak output pulse that cannot be conducted, even with a shielded cable, more than a short distance; or the scanner, power supply and detector circuit must all be an integral assembly mounted together at the burner. Both of these approaches are undesirable as they require sensitive circuitry to be operated in a hot, hostile environment.

The series connected quench circuit has a large capacitor. The quench circuit, power supply and detector circuitry may be located at a distance from the scanner and burner. High temperature circuitry or shielding is not required. Moreover, the instantaneous pulse current is of the order of 100 ma which is sufficient to directly power the LED of opto 1. Amplification is not required.

Figure 5:
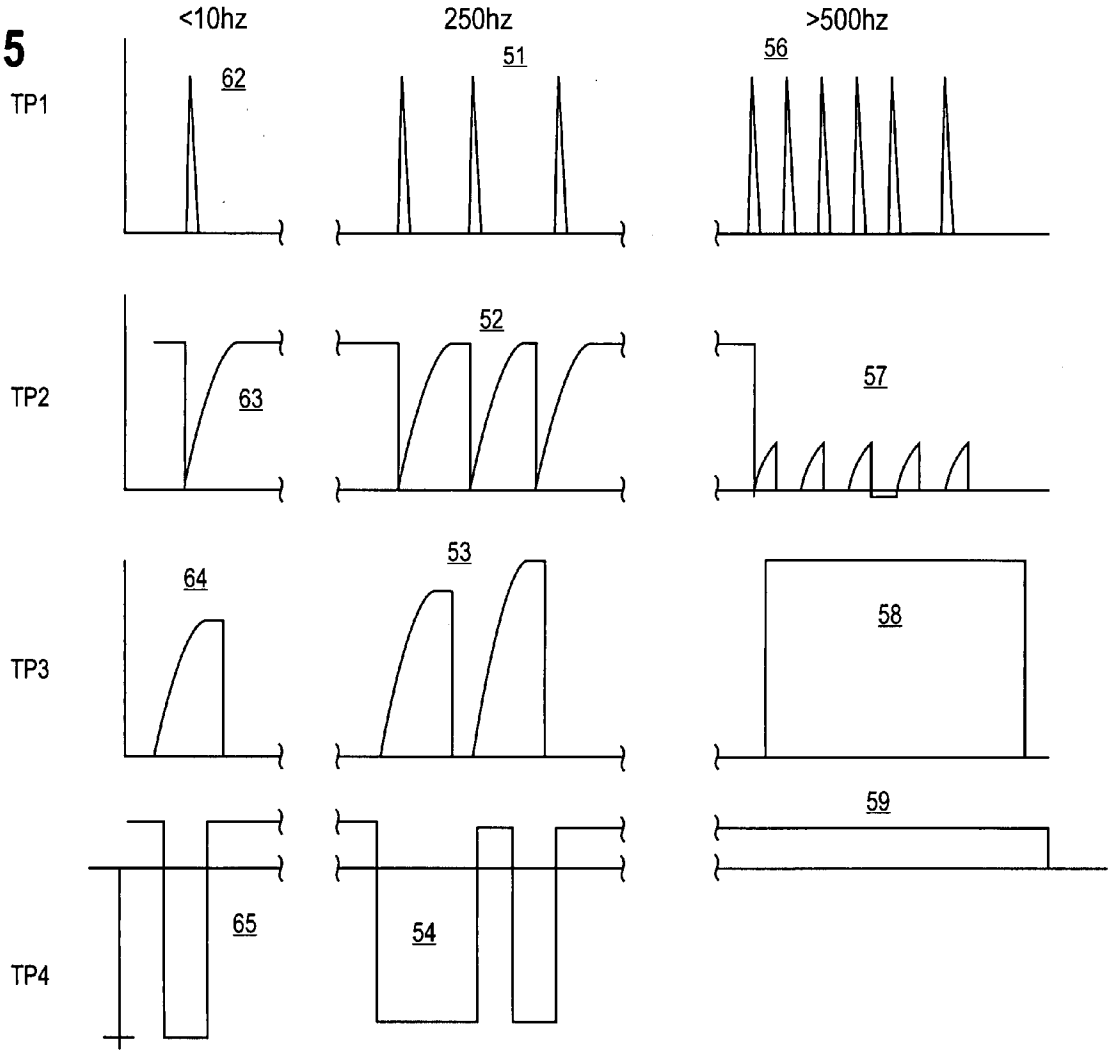
FIG. 5 is a series of diagrams illustrating voltage wave conditions in the flame detector circuit for different pulse signals in the UV tube cathode/anode circuit.

The pulses in the anode/cathode circuit of the ultraviolet tube 20 are coupled by opto 1 to FDCP 30. The signal at TP 1 is illustrated at 51, FIG. 5 for the nominal pulse frequency of 250 hz. Each pulse has a duration of 0.5 μsec and an amplitude of 18 volts. Each pulse turns Q4 on discharging C9 (0.22 μf) which charges again through R8 (1.5 meg Ω) between pulses. The voltage at TP2, across C9 is shown at 52. The frequency at TP2 is a maximum. The charge and discharge of C9 are as "square" as possible. Q5 is turned off with each pulse and conducts again as C9 charges. $V_{be}$ of Q5 is reached at about 63% of the RC time of R8, C9. When Q5 is turned off, C12 (0.22 μf) charges through R11 (47K Ω). When Q5 conducts again, C12 discharges through opto LED 2. At 250 hz, Q5 switches at its maximum frequency and efficiency. The power to opto LED 2 is at a maximum. The voltage at TP3, across Q5 and C12 in series with the combination of D7 and opto LED 2, is shown at 53. The voltage at TP4 across D7 and opto LED 2 is shown at 54. The pulse frequency at TP4 is approximately *frax*;1;10*th* the pulse frequency at TP1.

Opto LED 2 causes opto transistor 2 and Q8 to conduct with each negative pulse 54. At the end of each pulse, the collapse of current in the primary winding of transformer T2 induces a flyback voltage in the secondary winding which is rectified by diode Dl0 to charge three capacitors C18, C19, C20. The charge on the three capacitors then drains through terminal E and the current detector amplifier 33 of the combustion safeguard, FIG. 4 simulating the current from a flame rod. Fuel control relay 35 is energized closing contact Fl and opening fuel control valve 14. The three capacitors are used so that if one or even two fail, the circuit is still operative. The three capacitors also control the flame failure response time (FFRT) of the combustion safeguard. The combustion safeguard applies a high AC voltage, e.g., 390 volts AC, to the E terminal. R29, 10 meg Ω, limits the AC leakage current so that the combustion safeguard is not actuated by it.

If the UV tube 20 is contaminated, the pulse rate in the anode/cathode circuit is in excess of 500 hz. The signal at TP1 is as shown at 56, FIG. 5. In FDCP 30, R8 and C9 are of such values that the voltage across C9 never reaches $V_{be}$ of Q5 and Q5 ceases operation. The signal condition at TP2 is indicated at 57. The signal at TP3 remains at 18 volts as shown at 58; and the voltage at TP4 remains positive as shown at 59. Opto LED 2 does not conduct and there is no output from CPFS 31 to the current detector 33 of the combustion safeguard. Fuel valve 14 is closed.

With a no flame condition, the pulse signal from UV tube 20, as from noise, for example, is less than 10 hz. The signals at TP1 and TP2 are shown at 62 and 63, FIG. 5. The charge developed on C12 is insufficient to establish an output current from CPFS which will meet the current threshold of the combustion safeguard. The signals at TP3 and TP4 are shown at 64 and 65. Thus, the FDCP 30 distinguishes between the flame responsive desired pulse signal and undesired pulse signals and the CPFS 31 and combustion safeguard circuits control the fuel valve in response to the FDCP output signal.

A visual display of the pulse signal frequency in the UV tube cathode/anode circuit is provided by signal LED 67 in a relative signal indicator (RSI) circuit 68. Transistor Q10 is normally conducting and is turned off when its base is grounded by conduction of either Q8 or Q9. Q8 conducts when TP4 goes high. Q9 conducts when TP1 goes high. When Q10 is off, TP5 is high and current flows through R20, D11 and R21 to charge capacitor C15 which is connected with the anode of programmed unijunction transistor PT1, 2N6027. The trigger voltage of the gate of PUT1 is established by the voltage divider R24, R25. When PUT1 avalanches, Q11 conducts and signal LED67 is energized. As the energy of C16 is exhausted, PUT1 turns off. R23 and C16 are selected for a signal duration of the order of 200 milliseconds with a smooth ramp up and ramp down. The flashes of LED 67 provide a rough indication of the pulse frequency in the cathode/anode circuit of UV tube 20. With a minimum signal of 10 hz, LED 67 flashes once in 10 seconds. With the nominal pulse signal of 250 hz, LED 67 flashes twice per second. For a pulse signal of 500 hz, LED 67 is continuously illuminated.

Lockout circuit 40 provides for immediate closure of the fuel control valve 14 on occurrence of a pulse signal with a frequency greater than 500 hz, or other condition warranting that action. SCR1, when triggered, connects lockout relay CR1 across the low voltage supply, opening the contact CR1 between terminals 6 and 7 FIG. 4. This opens the power circuit to flame detector 33 of the combustion safeguard, closing the fuel valve 14, FIG. 4. Error LED 70 is energized providing a visual indication of the lockout condition. Energization of relay CR1 drains the charge from the low voltage filter capacitor C6. Concurrently the energization of error LED 70 drops the voltage at the base of Q1 to about 2.3 volts. The low voltage DC supply drops to 2.3 volts and FDCP 30, CPFS 31 and RSI 68 are inoperative.

Figure 4:
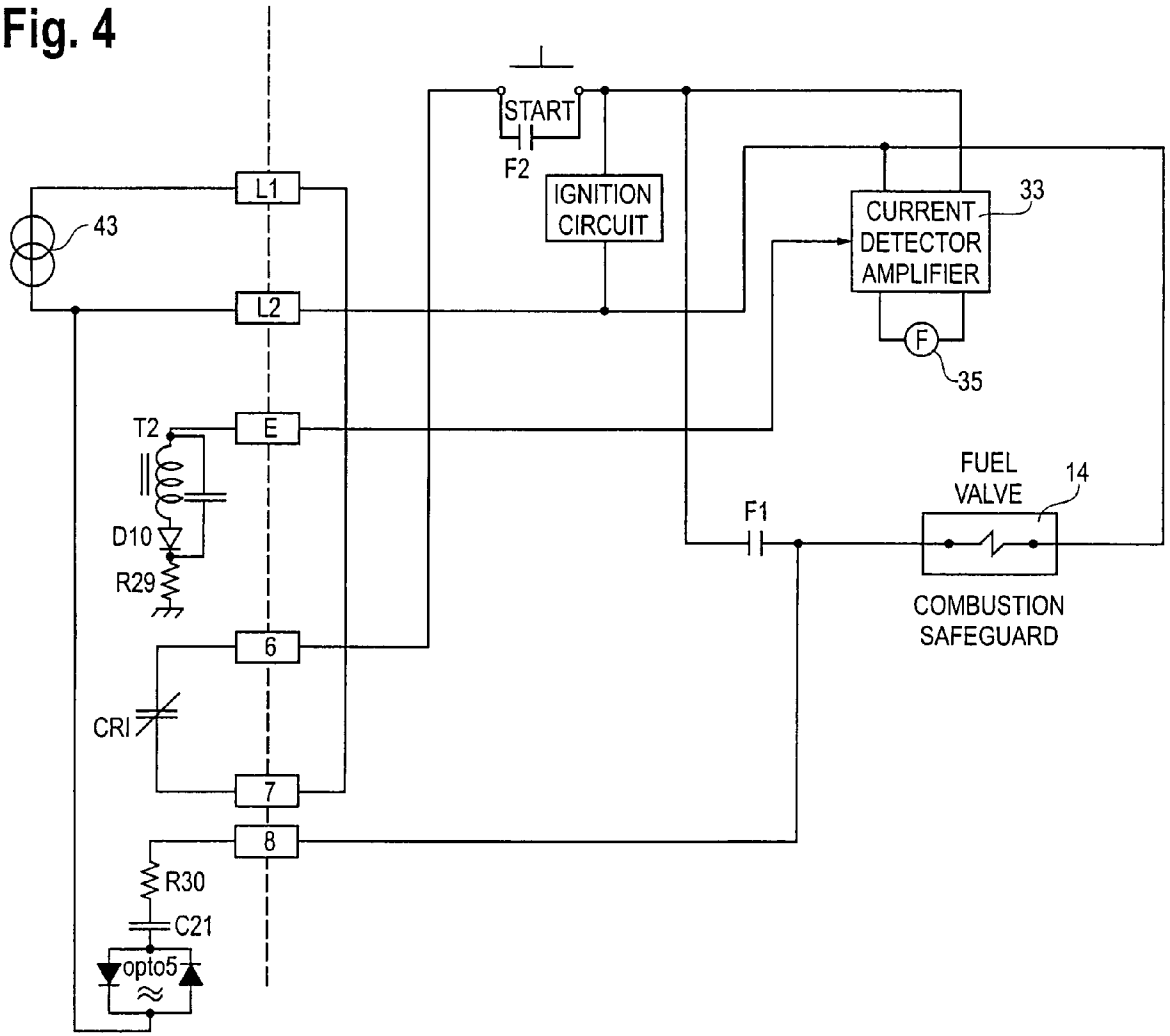
FIG. 4 is a simplified wiring diagram illustrating the interconnection of the flame detector, combustion safeguard and burner fuel valve.

After a lockout occurs, the flame detector and burner control are reset by interrupting the power to T1 momentarily and then restarting the burner by closing the start switch, FIG. 4. An ignition circuit (not shown), ignites the burner. When a flame signal is developed at terminal E and detected by the current detector amplifier 33, relay 35 is energized closing contact F1 in the circuit of fuel valve 14 and holding contact F2 across the start switch.

The circuit conditions which actuate lockout circuit 40 will now be considered.

With the pulse signal greater than 500 hz, the cycling of Q10 is such that C17, which charges through D12 and R27 when Q10 is off, is charged to the trigger voltage of SCR1 and it fires energizing lockout relay CR1.

Identification of a tube subject to an SSR condition is enhanced by periodically increasing the cathode/anode voltage. This causes an increased pulse count as a result of noise in the SSR tube and early identification of a tube subject to failure. Opto LED 4, in series with signal LED 67 causes conduction of opto transistor 4 on occurrence of a signal flash. This turns off SCR2, inserting zener Z3 in the high voltage regulator circuit. The high voltage is increased from −450 to −525 volts for the 200 millisecond duration of the signal. This simulates a noisy environment, as radioactivity, and drives a failing UV tube to an operating frequency above 500 hz.

If signal terminal S1 should short to signal ground 22, the voltage across R9 is greater than 36 volts, the rating for zener Z10, which conducts charging C17 through D13 and R35 to fire SCR1. Similarly, if CQ or RQ in the quench circuit 24 should short, S1 is effectively shorted to signal ground 22 through UV tube 20. Again, the voltage across R9 causes zener Z10 to conducts firing SCR1 and initiating a lockout condition.

The opto couplers are sensitive to fast rising electromagnetic noise which could mimic the fast rising pulses which FDCP 30 is designed to count. In order to ensure that the circuit responds to a pulse signal from UV tube 20 rather than to noise, a noise detector is provided. Q2, Q3 are connected in a Darlington configuration. A short piece of wire connected to the base of Q2 acts as an antenna. If Q2 and Q3 respond to noise, opto transistor 1 could also be responding to noise. Q2, Q3 short TP1 to ground limiting the operation of Q4 so that there is no output from FDCP 30. Q9, however, is turned on by the noise through bias resistor R5, turning Q10 off and allowing C17 to charge, firing SCR1 and initiating a lockout condition.

The lockout circuit is actuated to close the fuel valve in the event the valve is open in the absence of a flame. Terminal 8, FIG. 4, is connected with the terminal of fuel valve 14 which is connected to power terminal L1. A current through R30 and C21 powers the opto 5 LEDs, turning on opto 5 transistor which connects the gate of SCR1 through R14 with the low voltage supply. If a flame is present, the signal potential at TP3 charges C13 through D8, causing Q7 to conduct and disabling the opto 5 transistor, preventing actuation of the lockout circuit. Should a flame be lost, the charge on C13 holds Q7 on for about 1.5 seconds, preventing a false lockout from a momentary flame fluctuation. The flame failure response time (FFRT), i.e., the time for a burner control to close the fuel valve when a burner flame goes out must not, by Federal law, exceed 4 seconds. The energy stored in capacitors C18, C19 and C20 injects only enough power with a 5 μamp current to keep the valve open for 2–2.5 seconds. The total response time does not exceed 4 seconds; and the lockout circuit should close the fuel valve even faster. However, if the combustion safeguard should open the fuel valve when there is no flame, the lockout circuit is immediately actuated.

If the capacitors C18, C19 and C20 all should open, the high voltage AC from the combustion safeguard at terminal E would flow the ground through the secondary winding of transformer T2, D10 and R29, simulating the current flow from an ionizing flame rod. However, if there was no valid flame signal to the detector, Q7 would not conduct and the lockout circuit would be actuated closing the fuel valve.

The design of the power supplies is such that failure of the various components, either by short or open circuit, does not result in an erroneous flame signal. This is demonstrated in the following table.

TABLE

| Component | Short | Open |
|---|---|---|
| C1 thru C4 | T1 secondaries overloaded by D3 conducting to ground. Vo drops to ≈ −400 vdc. This is too low to ionize U.V. tube. | Entire High Voltage (H.V.) Doubler circuit is disconnected. Vo = 0 volts. UV tube cannot ionize |
| C5 | T1 secondary overloaded by D1. V ≈ −375 udc. See C1–C4. | LVS disconnected. Vcc = Ov. No operation. |
| D1 | C5–D2 junction grounded. No Vcc input. Vcc = Ov. No operation | C5 charges through D2 and C6. No Vcc input. Vcc = Ov. No operation. |
| D2 | C6 capacitive reactance shorts Vcc input. Vcc = Ov. | Same as C5 open. |
| D3 | Input to HVS shorted to ground. Vo = Ov. | C1–C4 charges thru R3, R9, C8 & D4. Vo = Ov. |
| D4 | 230 vac input to HVS. Too low to ionize U.V. tube. | Same as C1–C4 open. |
| Z1 | Vcc reference = Ov. Vcc = Ov. | Loading of circuit designed to limit voltage of VCC to ≈36 vdc. Lockout occurs sooner. Works normally. |
| C6 | Input to LVS shorted to ground. Vcc = Ov. | Vcc = ½ rectified 18 vdc. Insufficient power for circuit. No operation. |
| C8 | HVS "shorted". Vo ≈ Ov. | Vo ≈ ½ rectified (square wave) - 460 vdc. Insufficient power for U.V. tube and H.V. regulator shuts off low voltage circuit. No operation. |
| R9 | Not possible | Same as C8 open. |
| R1 | No change. Additional load within Z1's rating. | Bias to Q1 lost. Same as Z1 short. |
| R3 | No change | Same as C1–C4 open. |
| Q1 | Same as Z1 open | Vcc = Ov. |

Transformer T1 has a 6 VA rating. However, the power consumption of the circuit is approximately 2 VA. Whether the circuit is running, idling or locked out, the heat rise in the transformer is minimal. As indicated in the chart, if C1–C4, C5 or one or more rectifier diodes are shorted, T1 is loaded to a level that drops $V_O$ and $V_{cc}$ below voltages that could operate the circuit.

A UV tube with identical electrodes, as parallel wires or plates, can be operated with either electrode as the cathode and the other electrode the anode. The electrode connected as the cathode emits electrons in the presence of U.V. radiation and emits secondary electrons when impacted by ionized gas particles. The anode only absorbs electrons and is not affected by contamination or damage as much as the cathode. The condition of the cathode is more critical than that of the anode. Assume that a tube has one undamaged electrode and one minimally damaged electrode. If the tube is operated with undamaged electrode as cathode it will work normally until the anode damage becomes severe and ultimately fails. The sensor tube circuit of FIG. 6 has the UV tube, quench circuit and DC power supply connected to reverse electrode polarity periodically. Thus, each UV tube electrode serves alternately as cathode and anode. A tube with a contaminated electrode is detected immediately.

UV tube 73 has identical electrodes 74 and 75, as parallel wires. Electrode 74 is connected through quench circuit 77 with ground 78. Electrode 75 is connected through switching circuit 80 to DC power supply 81. In turn, the power supply is connected through switching circuit 80 and buffer 82 with ground 78. The illustrated switching circuit 80 consists of a double pole, double throw switch 84 operated by interval oscillator 85.

The positive terminal of power supply 81 is connected with switch pole 84*a* and the negative terminal with switch pole 84*b*. In the illustrated position of the switch 84, UV tube electrode 75 is connected with the positive terminal of the DC power supply and serves as the anode. The negative power supply terminal is connected through switch pole 84*b* with buffer section 82*a* of buffer 82 and returned to ground 78. With the opposite position of switch 84, electrode 75 is connected with the negative terminal of power supply 81 and serves as the cathode of UV tube 73. The positive terminal of the power supply is connected through buffer section 82*b* with ground 78. Each of the buffer sections 82*a* and 82*b* include LEDs 87*a*, 87*b* which actuate opto transistor 1, as in FIG. 2.

A suitable period for interval oscillator 85 is four seconds. If one of the UV tube electrodes 74, 75 is damaged, it is quickly identified.

Figure 6:
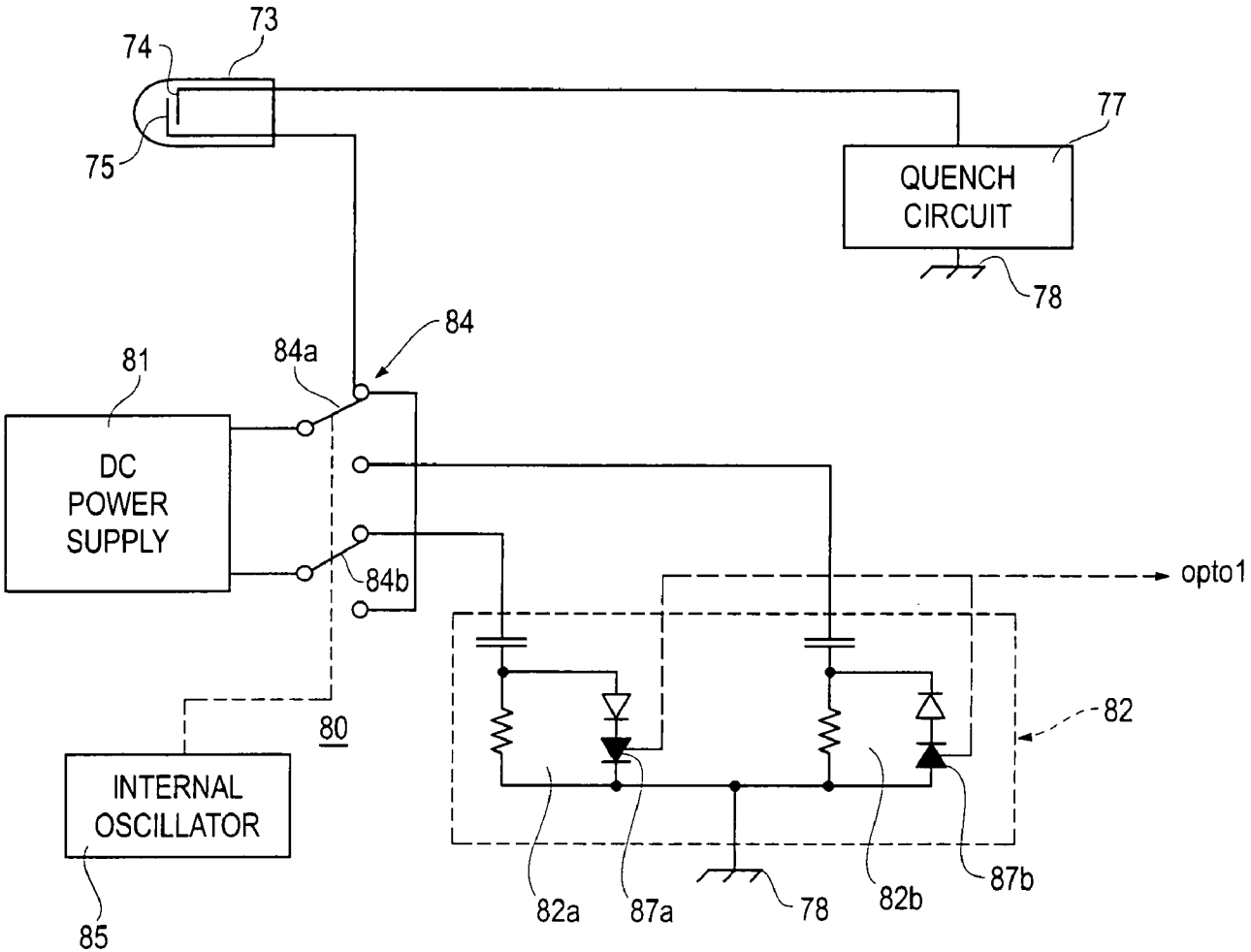
FIG. 6 is a schematic of a modified sensor tube circuit.

The mechanical switch 84 as shown in FIG. 6 is intended to be illustrative. Other switching mechanisms, as solid state switches may be used. Alternatively, two DC power supplies, one positive with respect to ground and the other negative could be used, and electrode 75 switches between them.

The invention claimed is:

1. A flame detector circuit comprising:

a UV flame sensor tube having a cathode and an anode;

a non-pulsed DC supply;

a cathode/anode circuit, including a quench circuit, series connecting the cathode and anode of the UV tube with said DC supply, a desired pulse signal being generated in said cathode/anode circuit by action of the quench circuit in the presence of a burner flame and undesired pulse signals being generated in said cathode/anode circuit by action of the quench circuit if said UV tube is contaminated or in the absence of a burner flame; and a discriminator circuit responsive to the pulse signal in said cathode/anode circuit for distinguishing between a desired flame responsive pulse signal and an undesired pulse signal to generate an output signal.

2. The flame detector of claim 1 in a burner fuel valve control, including an output circuit which opens said fuel valve in response to said desired pulse signal.

3. The flame detector of claim 1 in a burner fuel valve control, including an output circuit which closes said fuel valve in response to said undesired pulse signal.

4. The flame detector of claim 1 wherein the desired pulse signal has a selected intermediate frequency, the undesired pulse signals have a high frequency if UV tube is contaminated and a low frequency in the absence of a flame, and the discriminator circuit passes the intermediate frequency pulse signal to generate said output signal and rejects the high and low frequency pulse signals.

5. A flame detector circuit, comprising:

a UV flame sensor tube having a cathode and an anode;

a non-pulsed DC supply; and a cathode/anode circuit including a parallel resistor-capacitor quench circuit series connecting the UV tube with the DC supply.

6. The flame detector circuit of claim 5 further comprising a load element in said cathode/anode circuit for developing a pulse signal in response to detection of a flame.

7. In a flame detector circuit having a UV flame sensor tube with a cathode and an anode, a DC supply, a cathode/anode circuit, including a quench circuit, connecting the cathode and anode of the UV tube with said DC supply, a desired pulse signal being generated in said cathode/anode circuit by action of the quench circuit in the presence of a flame and undesired pulse signals being generated in said cathode/anode circuit by action of the quench circuit if the UV tube is contaminated or in the absence of a burner flame, the method of calibrating said detector circuit, comprising:

exposing said UV tube to a flame to generate a pulse signal at a frequency greater than a selected frequency; and attenuating the flame to which the tube is exposed to generate a desired pulse signal at said selected frequency.

8. The method of claim 7 in which ultraviolet radiation from the flame is attenuated by placing a screen between the flame and the tube.

9. A flame detector comprising:

a UV gas discharge tube having anode and cathode electrodes;

a non-pulsed DC power supply;

a quench circuit series connected with the UV tube anode and cathode electrodes and said power supply.

10. The flame detector of claim 9 in which said quench circuit includes a capacitor, said tube is located adjacent a flame and said DC power supply and an LED coupling circuit is are remote therefrom.

11. A flame detector circuit comprising:

a UV flame sensor tube having two identical electrodes;

a DC power supply;

a switching circuit connecting the UV electrodes and the quench circuit with the power supply, each UV tube electrode alternately having positive and negative charges and alternately serving as anode and cathode, a desired pulse signal being generated by action of the quench circuit in the presence of a burner flame, and undesired pulse signals being generated by action of the quench circuit if the UV tube is contaminated or in the absence of a burner flame, and a discriminator circuit responsive to the pulse signal to distinguish between desired and undesired pulse signals.

12. The flame detector of claim 11 in which the switching circuit includes a double throw switch and an interval oscillator actuating the switch.

13. A flame detector circuit comprising:

a UV flame sensor tube having a cathode and an anode;

a DC supply;

a cathode/anode circuit, including a quench circuit, connecting the cathode and anode of the UV tube with said DC supply, a desired pulse signal at a selected frequency being generated in said cathode/anode circuit by action of the quench circuit in the presence of a burner flame and undesired pulse signals at other frequencies being generated in said cathode/anode circuit by action of the quench circuit if said UV tube is contaminated or in the absence of a burner flame; and a frequency dependent charge pump discriminator circuit responsive to the pulse signal in said cathode/anode circuit for distinguishing between the desired flame responsive pulse signal and an undesired pulse signal to generate an output signal.

14. A flame detector circuit in a burner fuel valve control comprising:

a UV flame sensor tube having a cathode and an anode;

a DC supply;

a cathode/anode circuit, including a quench circuit, connecting the cathode and anode of the UV tube with said DC supply, a desired pulse signal being generated in said cathode/anode circuit by action of the quench circuit in the presence of a burner flame and undesired pulse signals being generated in said cathode/anode circuit by action of the quench circuit if said UV tube is contaminated or in the absence of a burner flame;

a discriminator circuit responsive to the pulse signal in said cathode/anode circuit for distinguishing between the desired flame responsive pulse signal and an undesired pulse signal to generate an output signal; and an output circuit comprising a combustion safeguard and a flame simulator responsive to the desired flame responsive pulse signal to generate a flame rod current, said combustion safeguard being responsive to the flame rod current to operate said fuel valve.

15. The flame detector of claim 14 in which said flame simulator is a charge pump including a transformer with a flyback circuit responsive to said intermediate frequency pulse signal to generate said flame rod current.

16. In a burner fuel valve control having a UV flame sensor tube with a cathode and anode, a non-pulsed DC supply, a cathode/anode circuit, including an RC quench circuit, connecting the cathode and anode of the UV tube with said DC supply, a desired pulse signal being generated in the cathode/anode circuit by action of the quench circuit in the presence of a burner flame and undesired pulse signals being generated in said cathode/anode circuit by action of the quench circuit if said UV tube is contaminated or in the absence of a burner flame, a discriminator circuit responsive to the pulse signal in said cathode/anode circuit for distinguishing between a desired flame-responsive pulse signal and an undesired pulse signal, to generate an output signal, and an output circuit responsive to said output signal to open said fuel valve in response to the output signal with said desired pulse signal and to close the fuel valve in response to the output signal with an undesired pulse signal, the improvement comprising:

a lockout circuit responsive to an abnormal condition of the flame detector circuit to close said fuel valve.

17. The lockout circuit of claim 16 which is responsive to an abnormal condition of the UV tube cathode/anode circuit.

18. The lockout circuit of claim 17 which is responsive to a short circuit of the UV tube.

19. The lockout circuit of claim 17 which is responsive to a short circuit of the quench circuit.

20. The lockout circuit of claim 17 which is responsive to a short circuit of the UV tube cathode/anode circuit.

21. The lockout circuit of claim 16 which is responsive to the output signal generated in response to the undesired pulse signal when said UV tube is contaminated.

22. The lockout circuit of claim 16 which is responsive to electrical noise.

23. The lockout circuit of claim 16 which is responsive to a condition energizing the fuel valve in the absence of a flame responsive signal, to close the fuel valve.

24. The lockout circuit of claim 16 including a time delay to prevent closing the fuel valve with a temporary loss of the flame responsive signal.

25. The flame detector of claim 16 further comprising a DC voltage supply for said discriminator circuit and a circuit responsive to operation of said lockout circuit for reducing the voltage of said DC voltage supply to disable said discriminator circuit upon operation of said lockout circuit.

26. The lockout circuit of claim 16 further comprising an SCR responsive to said abnormal condition of the flame detector circuit to conduct and actuate a relay to close said fuel valve.

27. A flame detector circuit comprising:

a UV flame sensor tube having a cathode and an anode;

a DC supply;

a cathode/anode circuit, including a quench circuit, connecting the cathode and anode of the UV tube with said DC supply, a desired pulse signal being generated in said cathode/anode circuit by action of the quench circuit in the presence of a burner flame and undesired pulse signals being generated in said cathode/anode circuit by action of the quench circuit if said UV tube is contaminated or in the absence of a burner flame;

a discriminator circuit responsive to the pulse signal in said cathode/anode circuit for distinguishing between the desired flame responsive pulse signal and an undesired pulse signal to generate an output signal; and a circuit responsive to the desired pulse signal for periodically increasing the DC voltage applied to the UV sensor tube, increasing susceptibility of the UV sensor tube for contamination.

28. A flame detector circuit comprising:

a UV flame sensor tube having a cathode and an anode;

a DC supply;

a cathode/anode circuit, including a quench circuit, connecting the cathode and anode of the UV tube with said DC supply, a desired pulse signal being generated in said cathode/anode circuit by action of the quench circuit in the presence of a burner flame and undesired pulse signals being generated in said cathode/anode circuit by action of the quench circuit if said UV tube is contaminated or in the absence of a burner flame;

a discriminator circuit responsive to the pulse signal in said cathode/anode circuit for distinguishing between the desired flame responsive pulse signal and an undesired pulse signal to generate an output signal; and a high voltage DC power supply for the UV tube anode/cathode circuit and a low voltage DC supply for the discriminator circuit, said high voltage DC supply having a minimum operating voltage, and a circuit for disabling the low voltage DC supply if the high voltage DC supply is less than said minimum.

29. A flame detector circuit comprising:

a UV flame sensor tube having a cathode and an anode;

a DC supply;

a cathode/anode circuit, including a quench circuit, connecting the cathode and anode of the UV tube with said DC supply, a desired pulse signal being generated in said cathode/anode circuit by action of the quench circuit in the presence of a burner flame and undesired pulse signals being generated in said cathode/anode circuit by action of the quench circuit if said UV tube is contaminated or in the absence of a burner flame;

a discriminator circuit responsive to the pulse signal in said cathode/anode circuit for distinguishing between the desired flame responsive pulse signal and an undesired pulse signal to generate an output signal; and a buffer circuit between said UV tube cathode/anode circuit and said discriminator.

30. The flame detector of claim 29 in which said buffer circuit comprises an optocoupler.

31. The flame detector of claim 30 wherein said optocoupler buffer circuit is operated substantially at ground potential.

32. A burner fuel valve control comprising:

a UV flame sensor tube having a cathode and an anode;

a DC supply;

a cathode/anode circuit, including a quench circuit, connecting the cathode and anode of the UV tube with said DC supply, a desired pulse signal being generated in said cathode/anode circuit by action of the quench circuit in the presence of a burner flame and undesired pulse signals being generated in said cathode/anode circuit by action of the quench circuit if said UV tube is contaminated or in the absence of a burner flame;

a discriminator circuit responsive to the pulse signal in said cathode/anode circuit for distinguishing between the desired flame responsive pulse signal and an undesired pulse signal to generate an output signal;

an output circuit which controls a fuel valve in accordance with the output signal of the discriminator circuit; and an optocoupler between said discriminator circuit and said output circuit.

33. A flame detector circuit comprising:

a UV flame sensor tube having a cathode and an anode;

a DC supply;

a cathode/anode circuit, including a quench circuit, connecting the cathode and anode of the UV tube with said DC supply, a desired pulse signal being generated in said cathode/anode circuit by action of the quench circuit in the presence of a burner flame and undesired pulse signals being generated in said cathode/anode circuit by action of the quench circuit if said UV tube is contaminated or in the absence of a burner flame;

a discriminator circuit responsive to the pulse signal in said cathode/anode circuit for distinguishing between the desired flame responsive pulse signal and an undesired pulse signal to generate an output signal the discriminator circuit including an optocoupler which is subject to electrical noise; and an electrical noise detector which disables the discriminator circuit on the occurrence of electrical noise.

* * * * *